US007584612B2

(12) United States Patent
Hill

(10) Patent No.: US 7,584,612 B2
(45) Date of Patent: Sep. 8, 2009

(54) LINEAR FREE PISTON STIRLING MACHINE

(75) Inventor: Andrew Nicholas Hill, Peterborough (GB)

(73) Assignee: Microgen Energy Limited, Reading, Berkshire (GB)

( * ) Notice: Subject to any disclaimer, the term of this patent is extended or adjusted under 35 U.S.C. 154(b) by 47 days.

(21) Appl. No.: 11/659,529

(22) PCT Filed: Aug. 4, 2005

(86) PCT No.: PCT/GB2005/003075

§ 371 (c)(1),
(2), (4) Date: Oct. 9, 2007

(87) PCT Pub. No.: WO2006/013380

PCT Pub. Date: Feb. 9, 2006

(65) Prior Publication Data

US 2008/0047265 A1 Feb. 28, 2008

(30) Foreign Application Priority Data

Aug. 6, 2004 (GB) ..... 0417610.3

(51) Int. Cl.
*F01B 29/10* (2006.01)

(52) U.S. Cl. ..... 60/517; 60/520

(58) Field of Classification Search ..... 60/517–526, 60/516

See application file for complete search history.

(56) References Cited

U.S. PATENT DOCUMENTS

| | | | | |
|---|---|---|---|---|
| 3,782,859 | A | 1/1974 | Schuman | 417/207 |
| 4,397,155 | A | 8/1983 | Davey et al. | 62/6 |
| 4,475,346 | A * | 10/1984 | Young et al. | 62/6 |
| 5,693,991 | A | 12/1997 | Hiterer et al. | 310/30 |
| 6,050,092 | A * | 4/2000 | Genstler et al. | 60/520 |
| 6,199,381 | B1 | 3/2001 | Unger et al. | |
| 2008/0256945 | A1 | 10/2008 | Welty et al. | |

FOREIGN PATENT DOCUMENTS

| | | |
|---|---|---|
| EP | 1 467 159 | 10/2004 |
| GB | 2 114 673 | 8/1983 |
| GB | 2 136 087 | 9/1984 |
| JP | 58 210379 | 12/1983 |
| JP | 2003-75006 | 3/2003 |
| JP | 2003-314919 | 11/2003 |

OTHER PUBLICATIONS

International Search Report mailed Feb. 3, 2006, and Written Opinion for PCT/GB2005/004957.

* cited by examiner

*Primary Examiner*—Hoang M Nguyen
(74) *Attorney, Agent, or Firm*—Ballard Spahr Andrews & Ingersoll, LLP

(57) ABSTRACT

A linear free piston Stirling machine having an overstroke prevention mechanism for the power piston. A resilient member is fixed to the casing which contacts the power piston 4 when its displacement exceeds a predetermined level.

3 Claims, 2 Drawing Sheets

LINEAR FREE PISTON STIRLING MACHINE

CROSS REFERENCE TO RELATED APPLICATIONS

The present application claims priority to Great Britain Patent Application No. 0417610.3 filed 6 Aug. 2004, which application is incorporated herein fully by this reference.

The present invention relates to a linear free piston Stirling machine. Such a machine may be an engine, for example, for use in a domestic combined heat and power system, or may be a cooler for a refrigerating system.

The displacer and power piston within the free piston machine are tuned as a mechanical spring-mass-damper resonators which reciprocate independently. A flexible rod, the lower end of which is fastened to a planar spring located in a lower dome of the machine, passes through the centre of the piston and is connected to the lower part of the displacer.

As the piston reciprocates in the Stirling engine, a magnet drum connected to this piston moves through coils of an alternator, so generating electricity.

Various approaches have been adopted in order to maintain the amplitude of reciprocation of the power piston within the physical limit of the design and avoid collisions at the end of each stroke. For example, two rows of secondary magnets have been incorporated on the magnet drum, in addition to the main field magnet as described in U.S. Pat. No. 5,148,066. The secondary magnets produce a magnetic spring which keeps the amplitude of reciprocation within the required limits. However, the inclusion of the magnets reduces the efficiency of the system due to a reduction in the density of magnetic flux produced by the field magnets, caused by fringing fields extending above and below the spring magnets.

An alternative approach adopted in GB 2136087 is to use a spring attached to the reciprocating body. This has the disadvantage of increasing the mass which is to be reciprocated.

A further alternative is to use a gas spring as shown in DE 1 953 8422 and JP 4047150 to provide a cushioning effect. However, these reduce the efficiency of the engine as, in order to exert sufficient force to prevent collisions, the gas spring forces must start to act at a point where overstroke is not a risk. This unnecessary expenditure of energy will reduce the efficiency of the design.

It is an object of the present invention to provide an overstroke prevention mechanism which does not increase the mass to be reciprocated and which also does not cause parasitic power loss when the engine is reciprocated within normal limits.

According to the present invention, there is provided a linear free piston Stirling machine comprising a displacer and a power piston which are reciprocally mounted within a casing; an alternator electromagnetically coupled, in use, with the power piston; and an overstroke prevention mechanism which is fixed with respect to the casing and which comprises at least one resilient member, wherein the power piston comes into contact with the overstroke prevention mechanism when its displacement exceeds a predetermined level.

By providing an overstroke prevention mechanism in the form of a resilient member mounted to the casing, there is no increase in the reciprocating mass. Further, by positioning the mechanism so that the piston comes into contact with the mechanism when its displacement exceeds a predetermined level no power loss is caused during normal operation. The resilient member is able to have a significant effect over its short range of motion, it therefore does not need to begin to operate in the normal operation region as in the case of the gas spring.

In the broadest sense, the overstroke prevention mechanism can be used only to prevent overstroking in one direction as this may be sufficient in certain circumstances, or it is possible to use some different overstroke prevention mechanisms to prevent overstroking in the opposite direction. However, preferably, the power piston comes into contact with the overstroke prevention mechanism when its displacement exceeds a predetermined level in either direction of reciprocation of the power piston. Such an arrangement can prevent overstroking in either direction.

One way of implementing this is for the overstroke prevention mechanism to comprise a resilient member, wherein the power piston is provided with a first portion which is arranged to contact the resilient member if the displacement of the power piston exceeds the predetermined level in a first direction, and a second portion which is arranged to contact the resilient member if the displacement of the power piston exceeds the predetermined level in a second direction. Effectively, the single resilient member or a single group of resilient members prevent overstroking in both directions. This may be achieved either by providing the first and second portions in a recess within the power piston, or alternatively, providing the first and second portions on a separate component which projects from the power piston.

Alternatively, the overstroke prevention mechanism may comprise a first resilient member which is arranged to contact the power piston if the displacement of the power piston exceeds the predetermined level in a first direction and a second resilient member which is arranged to contact the power piston if the displacement of the power piston exceeds the predetermined level in a second direction. This effectively provides different resilient members to prevent overstroking in the two directions. Such a mechanism is more complex than the mechanism referred to above for the single resilient member or group of resilient members. However, there may be circumstances under which this would be the preferred option.

Examples of Stirling machines in accordance with the present invention will now be described with reference to the accompanying drawings, in which.

The structure and operation of a linear free piston Stirling machine is well-known in the art and will not be described in detail here.

Figure 1:
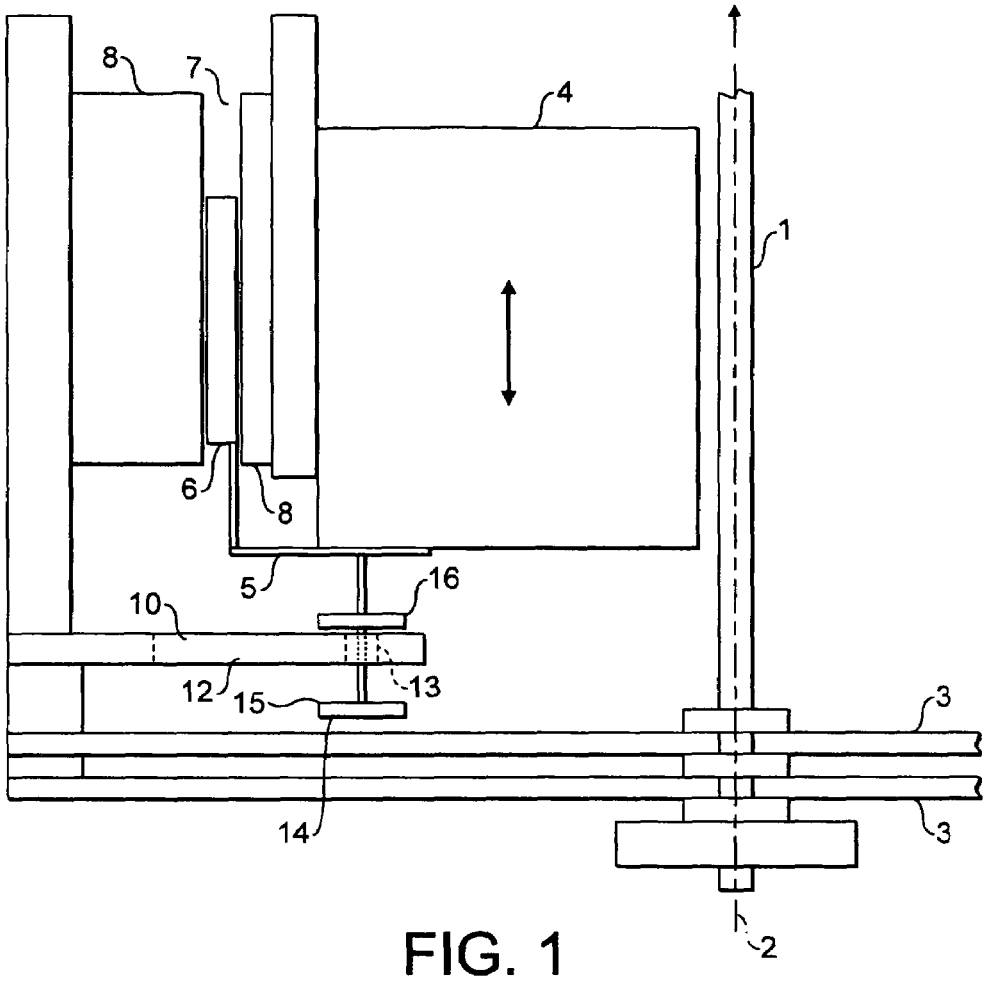
FIG. 1 is a schematic view of the various components in the base of the Stirling machine (left hand side only)

As is well-known, a displacer piston (not shown) is connected to a flexible rod 1 as shown in FIG. 1 which extends along the axis 2 of the machine. The machine is generally symmetrical about axis 2, although the right hand side is not shown in FIG. 1. The flexible rod 1 is connected at its lower end to a pair of planar springs 3 which provide a restoring force to the displacer. The rod 1 extends through the centre of power piston 4, the left-hand portion of which is shown in FIG. 1. The magnet drum 5 to which magnets 6 are attached is attached to reciprocate with the power piston. The magnets 6 reciprocate in the gap 7 within the alternator pack 8 which is fixed with respect to the machine housing.

Figure 2:
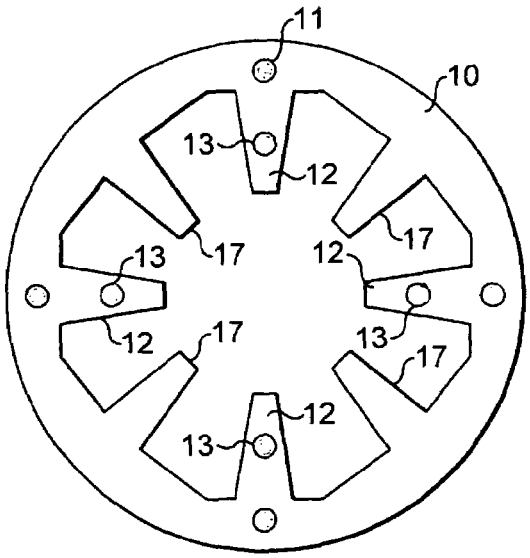
FIG. 2 is a plan of the resilient member of FIG. 1.

The overstroke mechanism is a resilient member 10 which is shown in detail in FIG. 2. This has an annular configuration and has a number of mounting holes 11 for mounting to the machine casing. A number of resilient tongues 12 project radially inwardly and are provided with holes 13. As shown in FIG. 1, a spring contact peg 14 projects through each of these holes 13. The spring contact peg 14 is provided with a lower flange 15 and an upper flange 16. As shown in FIG. 2 a number of further resilient tongues 17 are provided between the resilient tongues 12 these provide extreme one way stops. Four spring contact pegs 14 are contemplated and this is the optimum number. However, this example could be made to work with only two pegs positioned on opposite sides of the resilient member 10 so long as the power piston was correctly aligned. This example would also work reasonably with three spring contact pegs 14 spaced at 120° intervals.

When the power piston 4 exceeds its normal travel in an upward direction, the lower flanges 15 of each tongue will come into contact with the resilient tongues 12 which will immediately apply a retarding force on the power piston. Similarly, if the power piston 4 exceeds its normal motion in the downward direction, the upward flanges 16 will contact the resilient tongues 12 and again apply a retarding force. Should the power piston 4 further exceed its normal travel, the bottom of the power piston will strike the further resilient tongues 17 providing a further increase in the retarding force.

Figure 3:
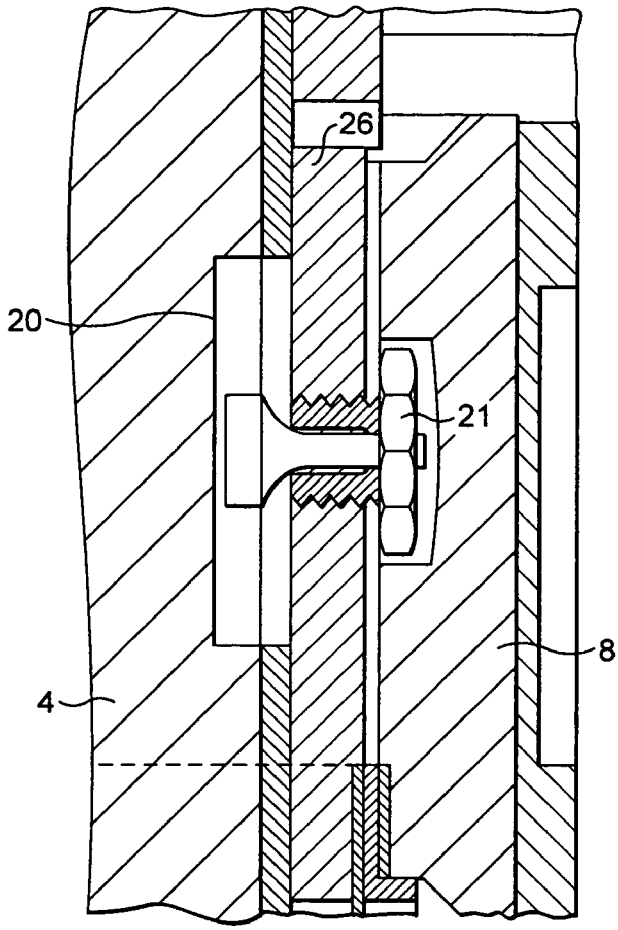
FIG. 3 shows a portion of the Stirling engine incorporating a second example of a resilient mechanism.
Figure 4:
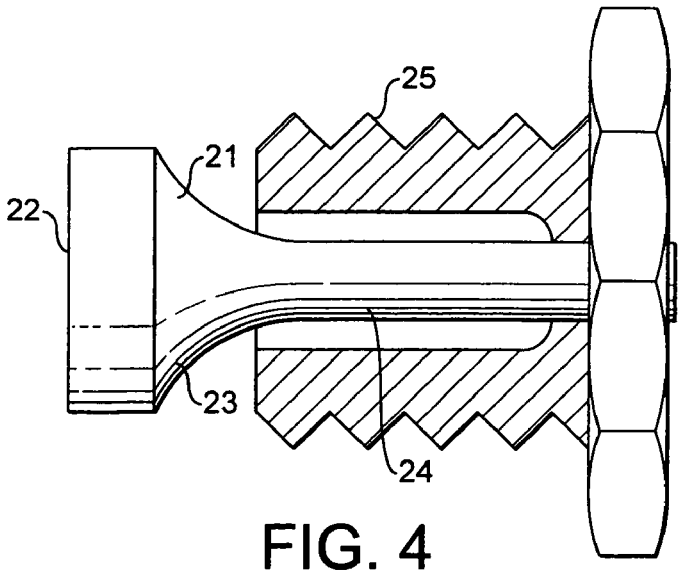
FIG. 4 is a schematic view of the resilient mechanism of FIG. 3 in greater detail.

An alternative arrangement is shown in FIGS. 3 and 4. In this case, the section has been taken from the right-hand side of the machine in that the piston 4 is within the alternator 8. The spring contact peg and resilient tongue arrangement of FIG. 1 has been replaced by a recess 20 in the piston 4 which extends in an axial direction and a spring plug 21. As shown in FIG. 3, where the spring plug 21 is mounted in the alternator 8 it projects into the groove 20. The spring plug is shown in greater detail in FIG. 4 which shows the spring plug having an enlarged head 22, a tapered portion 23 and a thinner stem 24 which provides the resilience. The stem 24 is a heavy press-fit into a fixing bolt 25 which is screwed into the cylinder wall 26. Another identical arrangement is provided at the opposite side of the machine.

If the piston 4 exceeds its allowed displacement in either direction, the spring plug 21 will contact the ends of the groove 20 and will apply a retarding force.

The invention claimed is:

1. A linear free piston Stirling machine comprising a displacer and a power piston which are reciprocably mounted within a casing; an alternator electromagnetically coupled, in use, with the power piston; and an overstroke prevention mechanism which is fixed with respect to the casing and which comprises at least one resilient member, wherein the power piston is provided with a first portion which is arranged to contact the resilient member if the displacement of the power piston exceeds the predetermined level in a first direction, characterised in that the power piston is provided with a second portion which is arranged to contact the same resilient member if the displacement of the power piston exceeds the predetermined level in a second direction.

2. A machine according to claim 1, wherein the first and second portions are provided in a recess within the power piston.

3. A machine according to claim 1, wherein the first and second portions are on a separate component which projects from the power piston.

* * * * *